US007601050B2

(12) United States Patent
Zuniga et al.

(10) Patent No.: US 7,601,050 B2
(45) Date of Patent: Oct. 13, 2009

(54) POLISHING APPARATUS WITH GROOVED SUBPAD

(75) Inventors: Steven M. Zuniga, Soquel, CA (US); Peter McReynolds, San Mateo, CA (US); Erik S. Rondum, San Ramon, CA (US); Benjamin A. Bonner, San Jose, CA (US); Henry H. Au, San Jose, CA (US); Gregory E. Menk, Pleasanton, CA (US); Gopalakrishna B. Prabhu, San Jose, CA (US); Anand N. Iyer, Santa Clara, CA (US); Garlen C. Leung, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 11/707,651

(22) Filed: Feb. 15, 2007

(65) Prior Publication Data

US 2007/0197141 A1 Aug. 23, 2007

Related U.S. Application Data

(60) Provisional application No. 60/773,950, filed on Feb. 15, 2006.

(51) Int. Cl.
*B24B 7/22* (2006.01)

(52) U.S. Cl. ..... 451/41; 451/288; 451/533

(58) Field of Classification Search ..... 451/6, 451/287, 288, 289, 527, 534, 533, 41
See application file for complete search history.

(56) References Cited

U.S. PATENT DOCUMENTS 1,291,572 A 1/1919 Lorenz
1,353,967 A * 9/1920 Lorenz ..... 451/494
5,212,910 A 5/1993 Breivogel et al.
5,257,478 A 11/1993 Hyde et al.
5,584,750 A 12/1996 Ishida et al.
5,645,469 A 7/1997 Burke et al.
5,650,039 A 7/1997 Talieh
5,658,190 A 8/1997 Wright et al.
5,704,827 A 1/1998 Nishi et al.
5,897,424 A * 4/1999 Evans et al. ..... 451/41
5,899,801 A 5/1999 Tolles et al.

(Continued)

FOREIGN PATENT DOCUMENTS

CN 1265618 A 6/2000

(Continued)

OTHER PUBLICATIONS

U.S. Appl. No. 11/124,420, filed May 6, 2005.

*Primary Examiner*—Robert Rose
(74) *Attorney, Agent, or Firm*—Fish & Richardson

(57) ABSTRACT

A polishing apparatus is described. The polishing apparatus includes a rotatable platen, a drive mechanism to incrementally advance a polishing sheet having a polishing surface in a linear direction across the platen, a subpad on the platen to support the polishing sheet, the subpad having a groove formed therein, and a vacuum source connected to the groove of the subpad and configured to apply a vacuum sufficient to pull portions of the polishing sheet into the groove of the subpad to induce a groove in the polishing surface.

14 Claims, 15 Drawing Sheets

U.S. PATENT DOCUMENTS

| | | | | |
|---|---|---|---|---|
| 5,921,855 | A | 7/1999 | Osterheld et al. | |
| 5,961,378 | A | 10/1999 | Inaba | |
| 6,135,856 | A | 10/2000 | Tjaden et al. | |
| 6,135,859 | A | 10/2000 | Tietz | |
| 6,220,942 | B1 | 4/2001 | Tolles et al. | |
| 6,224,935 | B1 | 5/2001 | Diaz et al. | |
| 6,244,935 | B1 * | 6/2001 | Birang et al. | 451/41 |
| 6,261,155 | B1 | 7/2001 | Jairath et al. | |
| 6,261,168 | B1 | 7/2001 | Jensen et al. | |
| 6,287,174 | B1 | 9/2001 | Detzel et al. | |
| 6,379,221 | B1 | 4/2002 | Kennedy et al. | |
| 6,425,803 | B1 | 7/2002 | Baker, III | |
| 6,491,570 | B1 | 12/2002 | Sommer et al. | |
| 6,561,891 | B2 | 5/2003 | Eppert, Jr. et al. | |
| 6,592,439 | B1 | 7/2003 | Li et al. | |
| 6,632,129 | B2 | 10/2003 | Goetz | |
| 6,685,548 | B2 | 2/2004 | Chen et al. | |
| 6,837,779 | B2 | 1/2005 | Smith et al. | |
| 6,913,518 | B2 | 7/2005 | Chen et al. | |
| 6,979,221 | B1 | 12/2005 | Hunter | |
| 7,040,694 | B2 | 5/2006 | Sedlack | |
| 2004/0072518 | A1 | 4/2004 | Prabhu et al. | |
| 2005/0098446 | A1 | 5/2005 | Tsai et al. | |
| 2005/0221723 | A1 | 10/2005 | Duboust et al. | |
| 2007/0197132 | A1 | 8/2007 | Menk et al. | |
| 2007/0197147 | A1 | 8/2007 | Rondum et al. | |

FOREIGN PATENT DOCUMENTS

| | | |
|---|---|---|
| WO | WO99/07515 | 2/1999 |

* cited by examiner

POLISHING APPARATUS WITH GROOVED SUBPAD

RELATED APPLICATION

This application claims the benefit of U.S. Provisional Application No. 60/773,950, filed Feb. 15, 2006, which is hereby incorporated by reference in its entirety.

TECHNICAL FIELD

This invention relates to manufacturing semiconductor devices.

BACKGROUND

The present invention relates to apparatus and methods for chemical mechanical polishing a substrate.

An integrated circuit is typically formed on a substrate by the sequential deposition of conductive, semiconductive or insulative layers on a silicon wafer. One fabrication step involves depositing a filler layer over a patterned stop layer, and planarizing the filler layer until the stop layer is exposed. For example, trenches or holes in an insulative layer may be filled with a conductive layer. After planarization, the portions of the conductive layer remaining between the raised pattern of the insulative layer form vias, plugs and lines that provide conductive paths between thin film circuits on the substrate.

Chemical mechanical polishing (CMP) is one accepted method of planarization. This planarization method typically requires that the substrate be mounted on a carrier or polishing head. The exposed surface of the substrate is placed against a rotating polishing pad. The polishing pad may be either a standard pad or a fixed-abrasive pad. A standard pad has a durable roughened surface, whereas a fixed-abrasive pad has abrasive particles held in a containment media. The carrier head provides a controllable load, i.e., pressure, on the substrate to push it against the polishing pad. A polishing slurry, including at least one chemically-reactive agent, and abrasive particles if a standard pad is used, is supplied to the surface of the polishing pad.

An effective CMP process not only provides a high polishing rate, but also provides a substrate surface which is finished (lacks small-scale roughness) and flat (lacks large-scale topography). The polishing rate, finish and flatness are determined by the pad and slurry combination, the relative speed between the substrate and pad, and the force pressing the substrate against the pad. The polishing rate sets the time needed to polish a layer, which in turn sets the maximum throughput of the CMP apparatus.

SUMMARY

In one aspect, a polishing article is described. The polishing article includes a linear polishing sheet having a linear transparent portion, wherein the linear transparent portion is formed from a material that has the flexibility to pass around a radius of about 2.5 inches without cracking.

Implementations of the invention may include one or more of the following features. A top surface of the polishing sheet can be substantially planar with a top surface of the linear transparent portion. The linear transparent portion can be formed from a polyurethane material. The material can have a hardness of about 60 on the Shore D scale. The material can have a thickness of about 50 mils. A top surface of the linear polishing sheet can be formed from a material that is sufficiently durable to withstand conditioning by a diamond-coated conditioning tool. A top surface of the linear polishing sheet can be formed from a non-fixed abrasive polishing material. The linear polishing sheet can include a top layer and a bottom layer. The linear polishing sheet can include a bonding layer between the lop layer and the bottom layer. The polishing sheet can include a polishing layer, and the transparent portion is molded to the polishing layer.

In another aspect, a polishing cartridge is described. The polishing cartridge includes two rollers, a feed roller and a take-up roller, and a linear polishing sheet, wherein a first end of the linear polishing sheet is wrapped around the feed roller and a second end of the linear polishing sheet is wrapped around the take-up roller.

In one aspect, a polishing apparatus is described. The polishing apparatus includes a rotatable platen, a drive mechanism to incrementally advance a polishing sheet having a polishing surface in a linear direction across the platen, a subpad on the platen to support the polishing sheet, the subpad having a groove formed therein, and a vacuum source connected to the groove of the subpad and configured to apply a vacuum sufficient to pull portions of the polishing sheet into the groove of the subpad to induce a groove in the polishing surface.

Implementations of the invention may include one or more of the following features. The subpad can include multiple grooves. The grooves can form concentric circles, concentric ovals, or a spiral. The grooves can form parallel lines or perpendicular lines. The polishing apparatus can include the polishing sheet. The polishing sheet can have multiple grooves in a polishing surface. The polishing sheet can have a width and a length, wherein the length is greater than the width, and the multiple grooves formed in the polishing sheet can include grooves extending substantially perpendicular to the length of the polishing sheet. The multiple grooves formed in the polishing sheet can include grooves extending substantially parallel to the length of the polishing sheet. The subpad can be more compressible than the polishing sheet. The subpad can be compressible.

In another aspect, a method is described. The method includes supporting a polishing sheet having a polishing surface on a subpad having a groove formed therein, and applying a vacuum to the groove sufficient to pull portions of the polishing sheet into the groove to induce a groove in the polishing surface.

Implementations of the invention may include one or more of the following features. The method can include rotating a platen supporting the polishing sheet to rotate the polishing sheet. The method can include bringing a substrate into contact with the polishing sheet and polishing the substrate. The method can include releasing the polishing sheet from the platen, and incrementally advancing the polishing sheet in a linear direction across the top surface of the platen. The subpad can include multiple grooves. The grooves can form concentric circles, concentric ovals, or a spiral.

In one aspect, a polishing system is described. The polishing system includes a polishing layer, and a subpad supporting the polishing layer, the subpad having a spiral groove formed therein.

Implementations of the invention may include one or more of the following features. The subpad can be formed of multiple layers of materials. The subpad can include an upper layer of polyurethane material and a lower layer of foam. The upper layer can have a thickness between about 60 mils and 100 mils and the lower layer has a thickness of between about 40 mils and 60 mils. The spiral groove can have a depth of between about 35 mils and 40 mils. The groove can extend entirely through an upper layer of the subpad. The subpad can have a thickness of about 150 mils. The spiral groove can have a depth of about 50 mils and a width of about 500 mils. The subpad can include multiple spiral grooves, and each spiral groove can originate from the center of the subpad. The subpad can be more compressible than the polishing layer.

In another aspect, a polishing system is described. The polishing system includes a rotatable platen, a drive mechanism to incrementally advance a polishing sheet in a linear direction across the platen, and a subpad on the platen to support the polishing sheet, where the subpad has a spiral groove formed therein.

Implementations of the invention may include one or more of the following features. The polishing system can include a motor to rotate the platen and a controller to control the motor, where the controller can be configured to cause the platen to rotate in a direction of increasing radius of the spiral groove. The controller can be configured to cause the platen to rotate in a direction of decreasing radius of the spiral groove.

In one aspect, a polishing system is described. The polishing system includes a polishing layer having a polishing surface with a first groove pattern, and a subpad supporting the polishing layer, where the subpad has a second groove pattern different than the first groove pattern.

In another aspect, a polishing article is described. The polishing article includes an elongated polishing layer, and a transparent carrier layer supporting the polishing layer, where the transparent carrier layer has a projection extending into an aperture in the polishing layer to provide a transparent window in the polishing layer.

Implementations of the invention may include one or more of the following features. The carrier layer can be integral with the transparent window. The carrier layer and the transparent window can be composed of a polymer material. The elongated polishing layer can have a length and a width, and the projection can be elongated in a direction parallel to the length. The window can extend substantially the entire length of the polishing layer. The polishing layer and the carrier layer can be adhered or welded together. An exposed surface of the transparent window can be substantially co-planar with an exposed surface of the polishing layer. Two sides of the projection can contact adjacent sides of the polishing layer. The carrier layer can extend across a width of the polishing layer. The carrier layer and the projection can not have a seam at the junction of the carrier layer and the projection.

In one aspect, a method is described. The method includes forming a polishing layer over a carrier layer having a raised transparent portion, wherein the transparent portion is not covered by the polishing layer.

Implementations of the invention may include one or more of the following features. Forming the polishing layer with the raised transparent portion can include one or more of molding, extruding, casting, shaping with pinch rollers, ablating, or mechanical milling. Forming a polishing layer over the carrier layer can include forming grooves in an upper surface of the polishing layer. The method can include drying or curing the carrier layer before forming the polishing layer over the carrier layer.

In another aspect, a method is described. The method includes forming a carrier layer with a raised transparent portion that projects into an aperture of a polishing layer, wherein the transparent portion is not covered by the polishing layer.

Implementations of the invention may include one or more of the following features. Forming the carrier layer can include fabricating an integral piece comprising a carrier portion and the raised transparent portion, the raised transparent portion providing a transparent window in the polishing layer, wherein the carrier portion can be exposed on a main surface and can be covered by the polishing layer on an opposite surface to the main surface and the transparent window can be exposed on both a surface substantially co-planar with a surface of the polishing layer and a surface substantially co-planar with the main surface of the carrier portion. Fabricating the piece can include removing polishing layer material covering the transparent window. Forming the carrier layer can include one or more of molding, extruding, casting, shaping with pinch rollers, ablating, or mechanical milling. The method can include drying or curing the polishing layer before fabricating the carrier layer on the polishing layer.

In one aspect, a method is described. The method includes contacting a non-solid material to a non-linear edge of a sheet of polishing material, and causing the non-solid material to solidify to form a window that contacts the non-linear edge of the polishing material.

Implementations of the invention may include one or more of the following features. The method can include contacting the non-solid material to a non-linear second edge of a second sheet of polishing material and causing the non-solid material to solidify to form a window that contacts the second non-linear edge of the second sheet of polishing material. The method can include supporting the first sheet and the second sheet with a gap there between and depositing the non-solid material into the gap. The window can extend substantially an entire length of the polishing article. Contacting a non-solid material to the edge of the sheet of polishing material and the second edge of the second sheet of polishing material can include pouring a liquid precursor material between the edge and the second edge. The solidified liquid precursor material can form multiple projections which interlock with projections of the polishing material. The window can extend along a primary axis. The non-linear edge can include multiple projections normal to the primary axis. Causing the non-solid material to solidify can form a window that fits into the sheet with a dovetail-like joint. An exposed surface of the window and an exposed surface of the polishing material can be substantially co-planar. The sheet of polishing material can be formed by cutting the sheet of polishing material or skiving the sheet from a block of polishing material. The window can extend a length of the polishing sheet between the edge of the polishing sheet and the center of the polishing sheet.

In another aspect, a polishing article is described. The polishing article includes a polishing sheet, and a solid light-transmissive window in the polishing sheet having a primary axis and a non-linear edge that extends parallel to the primary axis.

Implementations of the invention may include one or more of the following features. The polishing sheet can be elongated with a length and a width, where the length is greater than the width, and the primary axis is parallel to the length. The window can extend substantially the entire length of the polishing sheet. The non-linear edge can include multiple projections normal to the primary axis. The multiple projections can interlock with projections of the polishing material. The window can fit into the sheet with a dovetail-like joint. An exposed surface of the window and an exposed surface of the polishing material can be substantially co-planar.

In one aspect, a polishing apparatus is described. The polishing apparatus includes a platen, a subpad on the platen to support a polishing sheet having a polishing surface, the subpad having a recess formed therein, a vacuum source connected to the recess of the subpad and configured to apply a vacuum sufficient to pull portions of the polishing sheet into the recess of the subpad to induce a recess in the polishing surface, a carrier head to hold a substrate against the polishing surface and to lift the substrate away from the polishing surface, a motor to move the carrier head across the polishing surface, and a controller coupled to the carrier head and the motor and configured to position the substrate over the recess in the polishing surface and cause the carrier head to lift the substrate away from the polishing surface.

Implementations of the invention may include one or more of the following features. The platen can be rotatable. The polishing apparatus can include a drive mechanism to incrementally advance the polishing sheet in a linear direction across the platen. The controller can be configured to position the substrate away from the recess during polishing of the substrate. The recess can include a groove. The polishing apparatus can include the polishing sheet. The subpad can be more compressible than the polishing sheet.

In another aspect, a method is described. The method includes supporting a polishing sheet having a polishing surface on a subpad having a recess formed therein, applying a vacuum to the groove sufficient to pull portions of the polishing sheet into the recess to induce a recess in the polishing surface, positioning a substrate in a carrier head over the recess in the polishing surface, and lifting the substrate away from the polishing surface while the substrate is positioned over the recess.

Implementations of the invention may include one or more of the following features. The method can include rotating a platen supporting the polishing sheet to rotate the polishing sheet. The method can include incrementally advancing the polishing sheet in a linear direction relative to the subpad. The recess can include a groove.

Some of the embodiments described herein may include one or more of the following advantages. An integrated window stripe in a linear polishing sheet can be formed of a flexible and bendable material to allow the composite polishing sheet to pass around small bend radii without cracking, crazing, delaminating, or splitting at the interface. Using a grooved subpad to support a linear polishing sheet allows the linear sheet to develop groove patterns in a polishing surface while still advancing in small increments. Using a spiral-grooved subpad with deep grooves induces a spiral groove pattern in overlying pad material, where the induced groove pattern, in addition to providing local slurry transport, can perform a global action of retaining slurry on the platen or exhausting slurry and polish waste products off the platen and away from the wafer. Fabricating a polishing sheet with an integrated window stripe reduces the number of materials to two. Additionally, the polishing sheet and the integrated window and carrier can be fabricated of materials with similar chemical properties. Incorporating optical window material in a polishing sheet to create a dovetail-like joint increases the mechanical strength of the interface between the window material and the polishing sheet. Using a subpad with a feature to support a linear polishing sheet allows the linear sheet to develop the feature in a polishing surface while still advancing in small increments. The subpad feature can be used to assist substrate dechuck after polishing.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
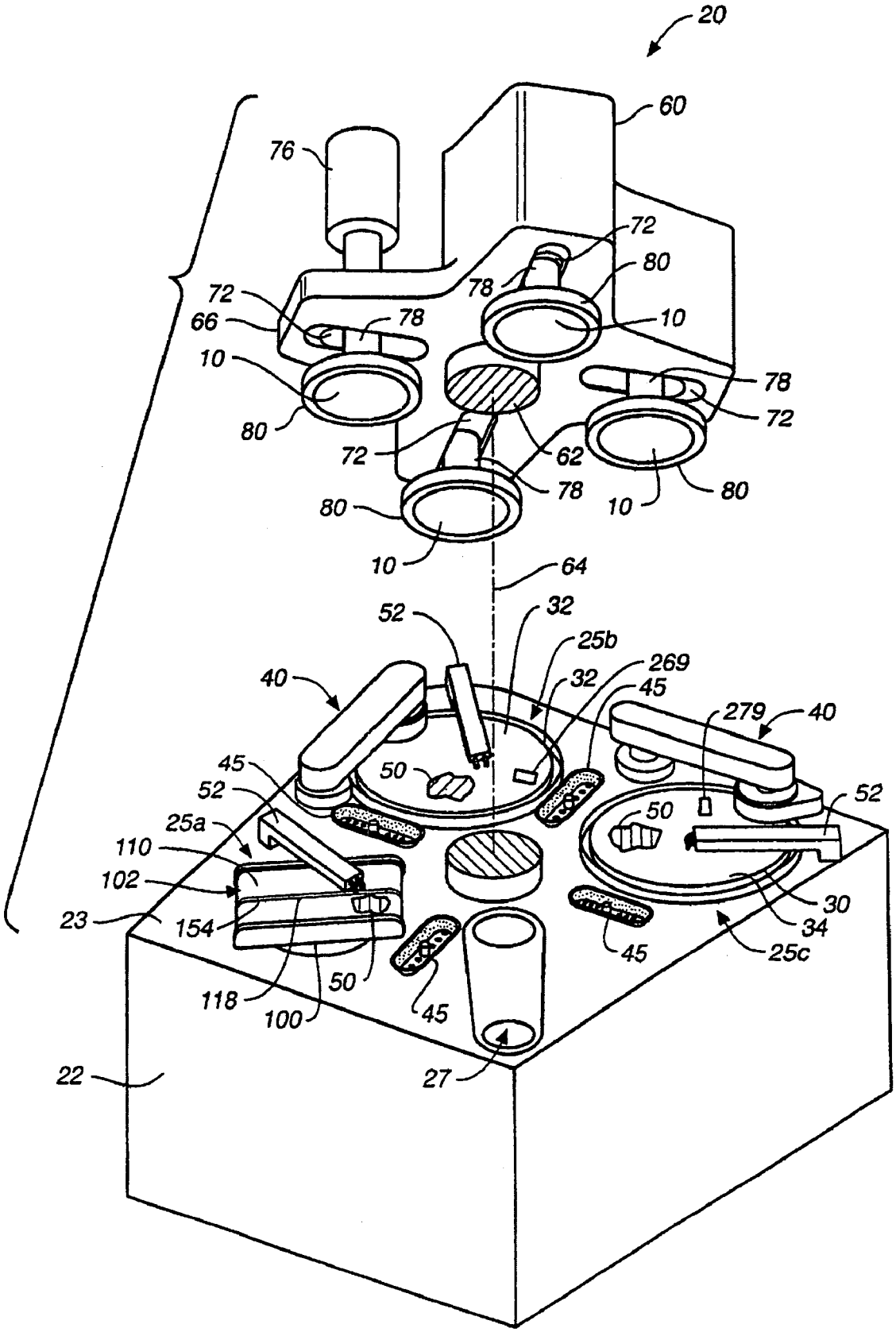
FIG. 1 is a schematic exploded perspective view of a chemical mechanical polishing apparatus.
Figure 2:
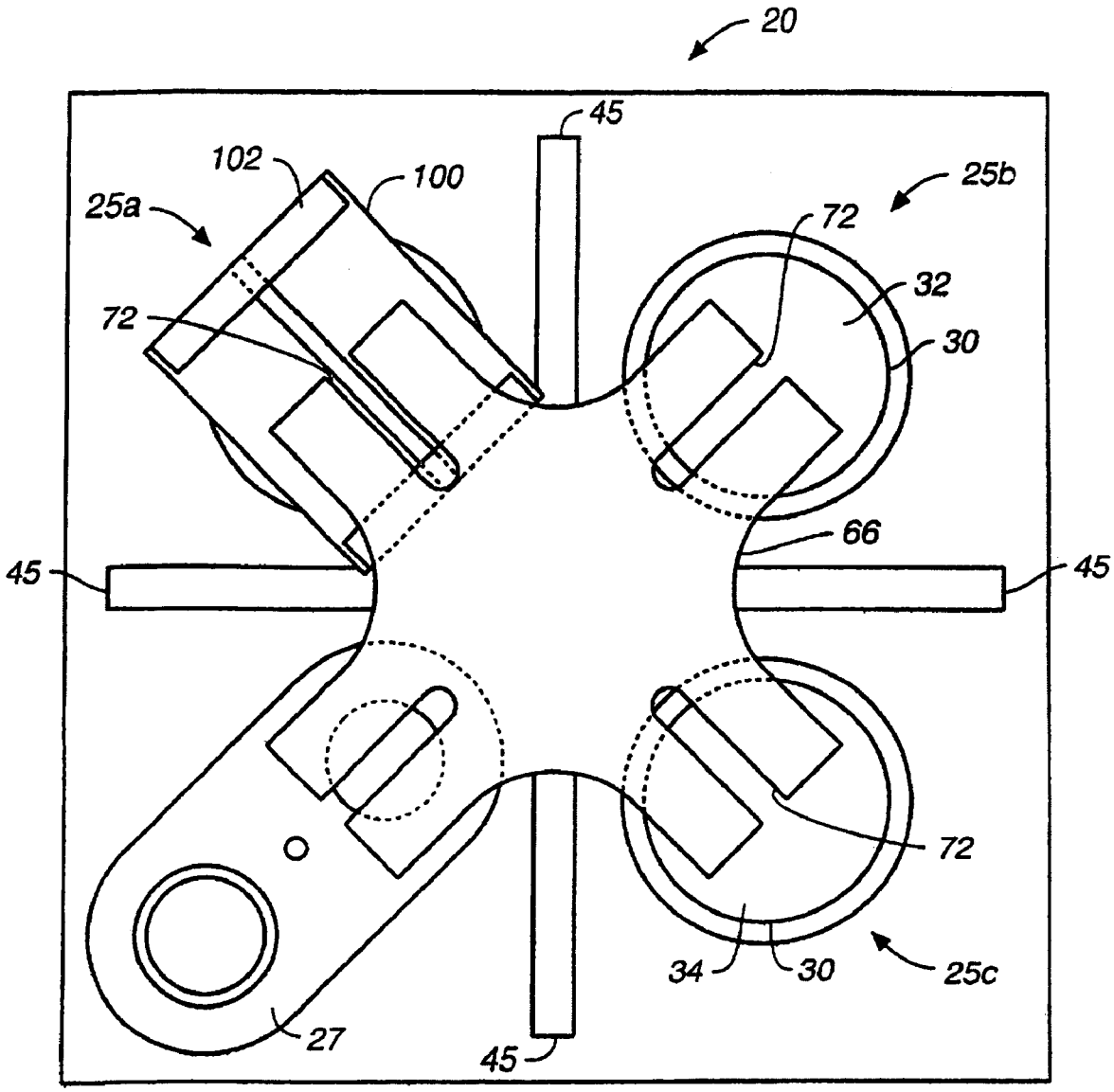
FIG. 2 is a top view of the CMP apparatus of FIG. 1.

Referring to FIGS. 1 and 2, one or more substrates 10 will be polished by a chemical mechanical polishing apparatus 20. An exemplary polishing apparatus 20 includes a machine base 22 with a table top 23 that supports a series of polishing stations, including a first polishing station 25*a*, a second polishing station 25*b*, and a final polishing station 25*c*, and a transfer station 27. Transfer station 27 serves multiple functions, including receiving individual substrates 10 from a loading apparatus (not shown), washing the substrates, loading the substrates into carrier heads, receiving the substrates from the carrier heads, washing the substrates again, and finally, transferring the substrates back to the loading apparatus. A description of a similar polishing apparatus may be found in U.S. Pat. No. 5,738,574, the entire disclosure of which is incorporated herein by reference.

Each polishing station includes a rotatable platen. At least one of the polishing stations, such as first station 25*a*, includes a polishing cartridge 102 mounted to a rotatable, rectangular platen 100. The polishing cartridge 102 includes a linearly advanceable sheet or belt of fixed-abrasive polishing material. The remaining polishing stations, e.g., second polishing station 25*b* and final polishing station 25*c*, may include polishing pads 32 and 34, respectively, each attached to a circular platen 30. Each platen may be connected to a platen drive motor (not shown) that rotates the platen at thirty to two hundred revolutions per minute, although lower or higher rotational speeds may be used. Assuming that substrate 10 is a 300 mm diameter disk, then rectangular platen 100 may be about thirty inches on a side, and circular platen 30 and polishing pads 32 and 34 may be about thirty inches in diameter.

Each polishing station 25*a*, 25*b*, and 25*c* also includes a combined slurry/rinse arm 52 that projects over the associated polishing surface. Each slurry/rinse arm 52 may include two or more slurry supply tubes to provide a polishing liquid, slurry, or cleaning liquid to the surface of the polishing pad. For example, the polishing liquid dispensed onto the fixed-abrasive polishing sheet at first polishing station 25*a* will not include abrasive particles, whereas the slurry dispensed onto the standard polishing pad at second polishing station 25*b* will include abrasive particles. If final polishing station 25*c* is used for buffing, the polishing liquid dispensed onto the polishing pad at that station would not include abrasive particles. Typically, sufficient liquid is provided to cover and wet the entire polishing pad. Each slurry/rinse arm also includes several spray nozzles (not shown) which provide a high-pressure rinse at the end of each polishing and conditioning cycle.

The polishing stations may include an optional associated pad conditioner apparatus 40. The polishing stations that include polishing pad, i.e., polishing station 25*a*, may include an optional unillustrated cleaning apparatus to remove grit or polishing debris from the surface of the polishing sheet. The cleaning apparatus may include a rotatable brush to sweep the surface of the polishing sheet and/or a nozzle to spray a pressurized cleaning liquid, e.g., deionized water, onto the surface of the polishing sheet. The cleaning apparatus can be operated continuously, or between polishing operations. In addition, the cleaning apparatus could be stationary, or it could sweep across the surface of the polishing sheet.

In addition, optional cleaning stations 45 may be positioned between polishing stations 25*a* and 25*b*, between polishing stations 25*b* and 25*c*, between polishing station 25*c* and transfer station 27, and between transfer station 27 and polishing station 25*a*, to clean the substrate as it moves between the stations.

In the exemplary polishing system, a rotatable multi-head carousel 60 is supported above the polishing stations by a center post 62 and is rotated about a carousel axis 64 by a carousel motor assembly (not shown). Carousel 60 includes four carrier head systems mounted on a carousel support plate 66 at equal angular intervals about carousel axis 64. Three of the carrier head systems receive and hold substrates, and polish them by pressing them against the polishing sheet of station 25*a* and the polishing pads of stations 25*b* and 25*c*. One of the carrier head systems receives a substrate from and delivers a substrate to transfer station 27.

Each carrier head system includes a carrier or carrier head 80. A carrier drive shaft 78 connects a carrier head rotation motor 76 (shown by the removal of one quarter of the carousel cover) to carrier head 80 so that each carrier head can independently rotate about its own axis. In addition, each carrier head 80 independently laterally oscillates in a radial slot 72 formed in carousel support plate 66.

The carrier head 80 performs several mechanical functions. Generally, the carrier head holds the substrate against the polishing surface, evenly distributes a downward pressure across the back surface of the substrate, transfers torque from the drive shaft to the substrate, and ensures that the substrate does not slip out from beneath the carrier head during polishing operations. A description of a suitable carrier head may be found in U.S. Pat. Nos. 6,183,354 and 6,857,945, filed May 21, 1997, the entire disclosures of which are incorporated herein by reference.

Figure 3A:
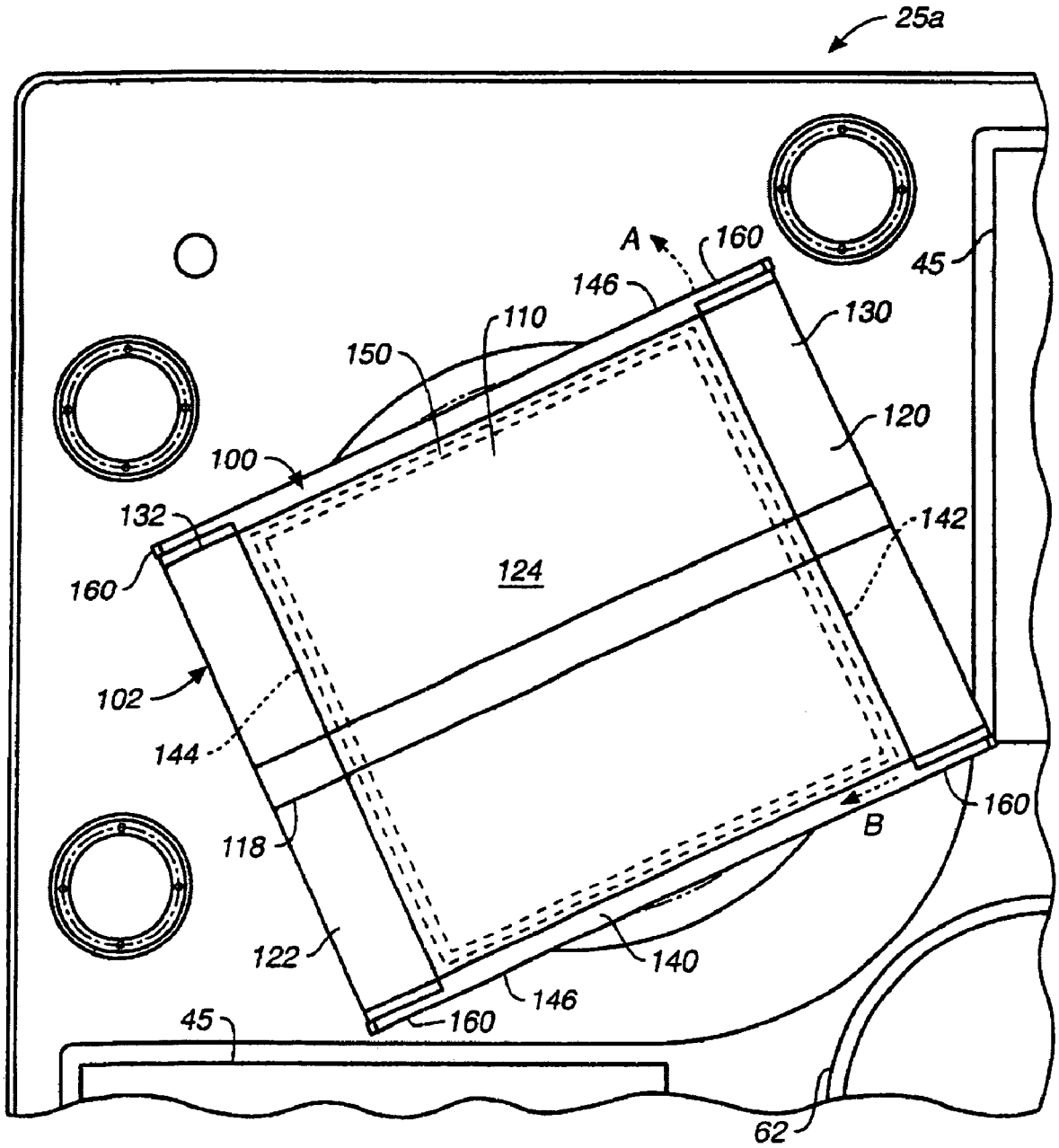
FIG. 3A is a top view of the first polishing station of the CMP apparatus of FIG. 1.
Figure 3B:
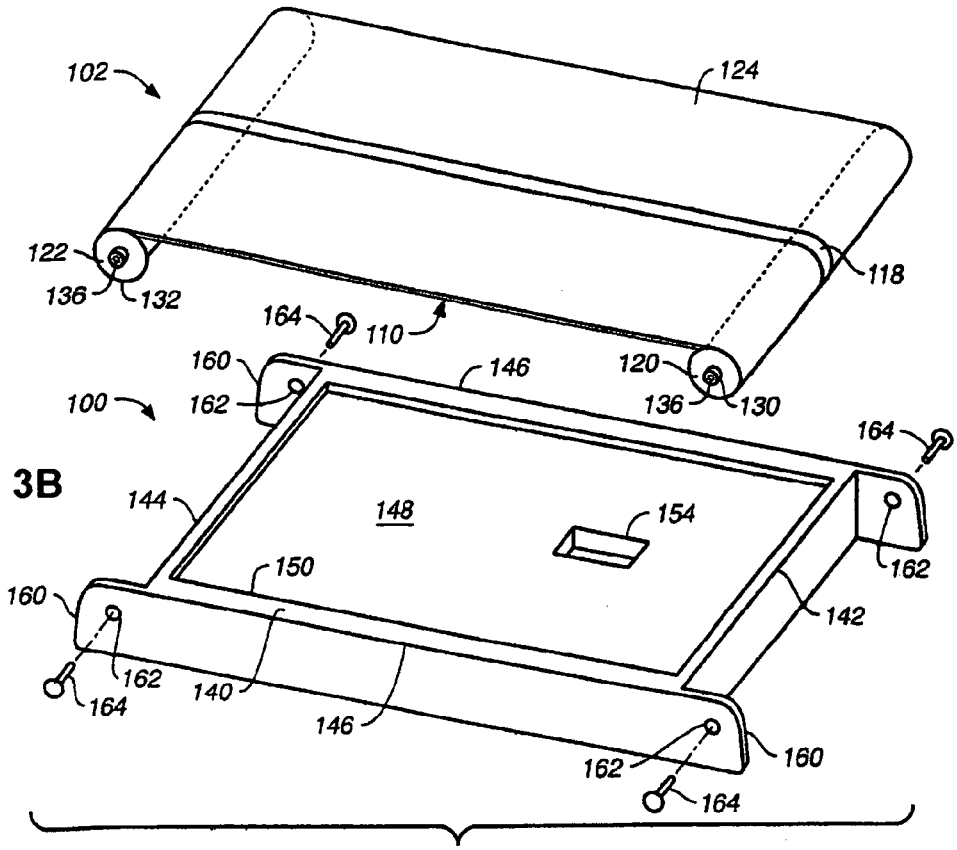
FIG. 3B is a schematic exploded perspective view of a rectangular platen and a polishing cartridge.
Figure 3C:
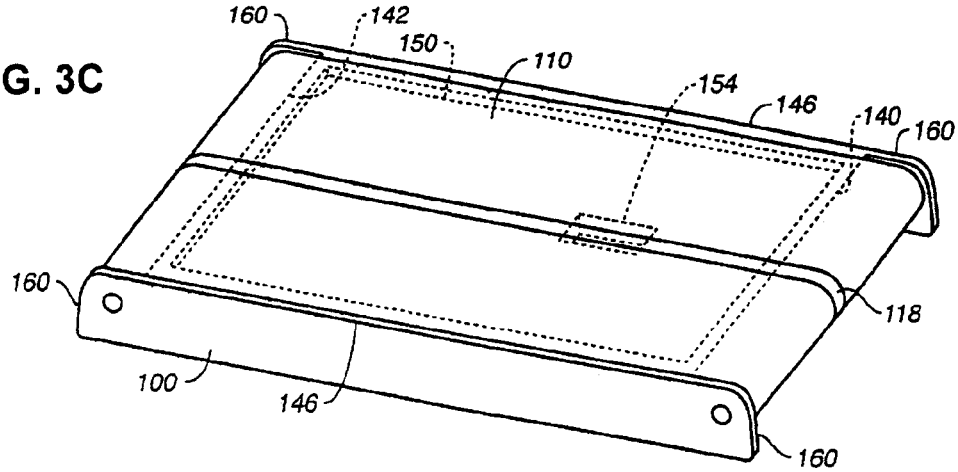
FIG. 3C is a schematic perspective view of a polishing cartridge attached to a rectangular platen.

Referring to FIGS. 3A, 3B, and 3C, polishing cartridge 102 is detachably secured to rectangular platen 100 at polishing station 25*a*. Polishing cartridge 102 includes a feed roller 130, a take-up roller 132, and a generally linear sheet or belt 110 of a polishing pad material. An unused or a fresh portion 120 of the polishing sheet is wrapped around feed roller 130, and a used portion 122 of the polishing sheet is wrapped around take-up roller 132. A rectangular exposed portion 124 of the polishing sheet that is used to polish substrates extends between the used and unused portions 120, 122 over a top surface 140 of rectangular platen 100.

Figure 14:
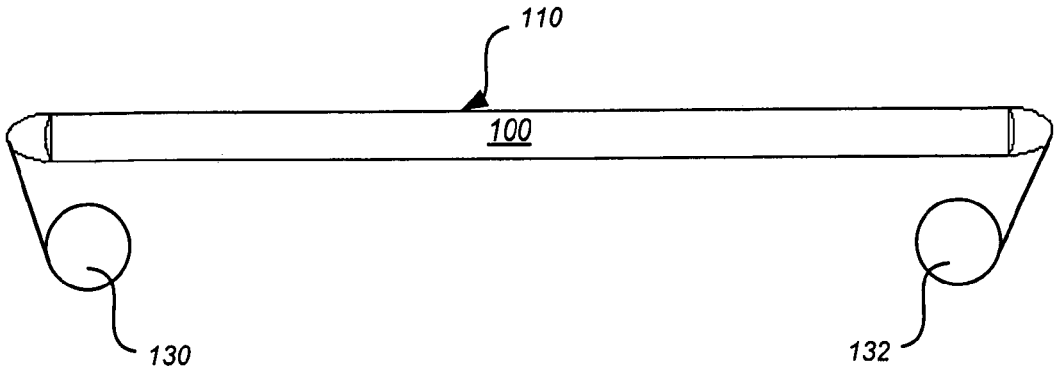
FIG. 14 shows a side view of a polishing sheet on a rectangular platen.

The rectangular platen 100 can be rotated (as shown by phantom arrow A in FIG. 3A) to rotate the exposed portion of the polishing sheet and thereby provide relative motion between the substrate and the polishing sheet during polishing. Between polishing operations, the polishing sheet can be advanced (as shown by phantom arrow B in FIG. 3A) to expose an unused portion of the polishing sheet. When the polishing material advances, polishing sheet 110 unwraps from feed roller 130, moves across the top surface of the rectangular platen 100, and is taken up by take-up roller 132 (as shown in FIG. 14).

Figure 4:
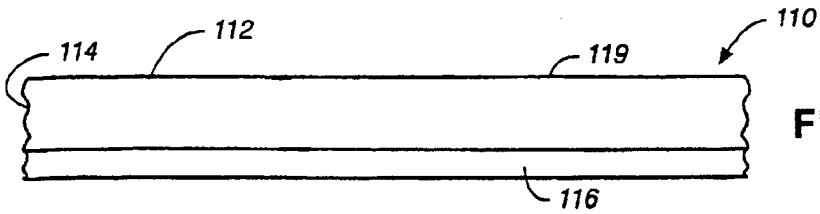
FIG. 4 is a schematic cross-sectional view of a fixed abrasive polishing sheet.

Referring to FIG. 4, in some embodiments, the polishing sheet 110 includes two layers. An upper polishing layer 119 is formed from a polishing material and a lower layer 116, such as a backing layer or carrier layer is formed from a film. The upper polishing layer 119 can be formed from a resin, such as a phenolic resins, polyurethane, urea-formaldehyde resin, melamine formaldehyde resin, acrylated urethane, acrylated epoxy, ethylenically unsaturated compound, aminoplast derivative having at least one pendant acrylate group, isocyanurate derivative having at least one pendant acrylate group, vinyl ether, epoxy resin, and combinations thereof. The sheet can also include fillers, such as hollow microspheres or voids. Lower layer 116 is a backing layer composed of a material such as a polymeric film, e.g., polyethylene terephthalate (PET), paper, cloth, a metallic film or the like. In some embodiments, the two layers are bonded together, such as with an epoxy or an adhesive, e.g., a pressure sensitive adhesive, or by welding the two layers together. The polishing layer can be between 10 and 150 mils, such as between 20 and 80 mils, such as around 40 mils thick. The polishing sheet 110 can be about twenty, twenty five or thirty inches wide.

Figure 11A:
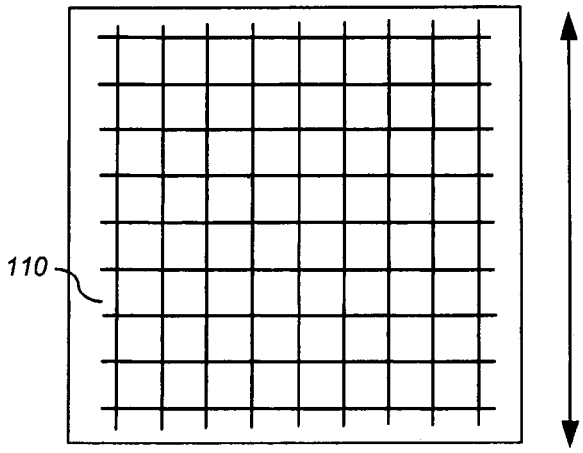
FIGS. 11A-11C show a polishing pad with grooves.
Figure 11B:
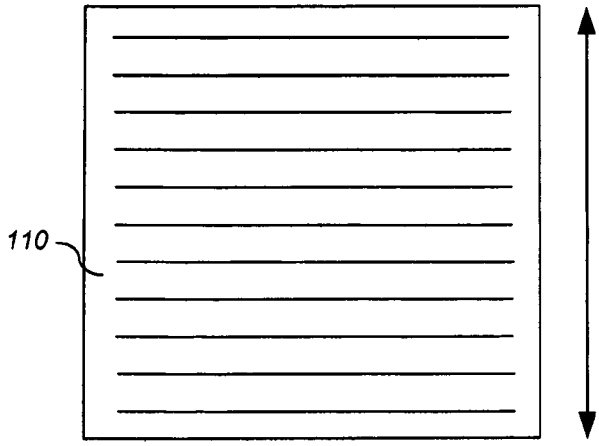
Figure 11C:
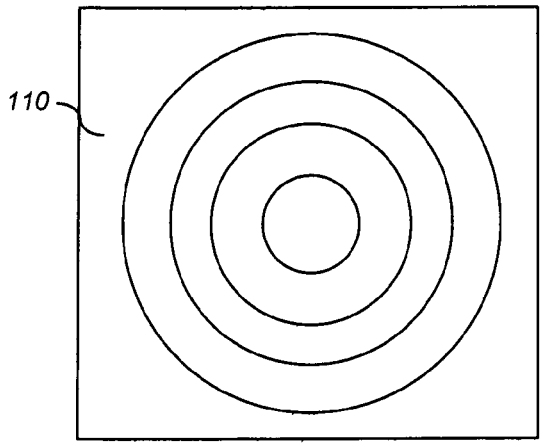

Referring to FIGS. 11A-11C, in some implementations, the upper polishing layer of the polishing sheet 110 has grooves in the top surface. The grooves can be of any configuration, but can be rotationally and translationally invariant. The grooves can be x-grooves, shown in FIG. 11B, that is, grooves that are arranged perpendicular to the direction of travel of the sheet, xy-grooves, shown in FIG. 11A, that is, grooves that are perpendicular and parallel to the direction of travel of the sheet, diagonal grooves, or other suitable groove pattern. In FIGS. 11A-11B, the arrows indicate the direction of travel. The grooves can be between about 45 and 5 mils deep, such as between about 35 and 15 mils, such as about 25 mils deep. In some implementations, the grooves are spaced closely together to aid in bending the polishing sheet, as described further herein.

Referring again to FIGS. 3A, 3B and 3C, a transparent strip 118 can be formed along the length of polishing sheet 110. The transparent strip 118 or window may be positioned at the center of the sheet, that is, the window can run the length of the polishing pad and be approximately equidistant to each pad edge, and may be between about 0.2 and 1 inch wide, such as between about 0.4 and 0.8 inches wide or about 0.6 inches wide. The transparent strip will be aligned with an aperture or transparent window 154 in rectangular platen 100 to provide optical monitoring of the substrate surface for end point detection, as discussed in greater detail below. The top surface of the transparent strip 118 can be planar with the top surface of the polishing portion of the polishing sheet 110. This arrangement prevents slurry from collecting on the transparent strip 118 and adversely affecting any metrology that is performed through the transparent strip 118.

The feed and take-up rollers 130 and 132 should be slightly longer than the width of polishing sheet 110. The rollers 130, 132 may be plastic or metal cylinders about 20" long and between about 2" and 2.5" in diameter. Because the polishing sheet 110 passes around the rollers 130, 132 many times, the transparent strip 118 is formed of a material that is not prone to cracking, crazing, delaminating or splitting, such as at the pad/strip interface. Ideally, the transparent strip is formed of a material sufficiently durable to hold up to conditioning with a diamond coated conditioning tool. In some implementations, the transparent strip 118 is integral with the backing layer, that is, the transparent strip 118 and the backing layer are made of the same material and are a single unit. In some implementations, the transparent strip can be molded to the polishing layer. In some implementations, the top surface of the transparent strip 118 is substantially planar with the top surface of the polishing sheet 110.

A commercially available material having many of the desired properties of the transparent strip is Calthane ND 3200 polyurethane (Cal Polymers, Long Beach, Calif.). The material is a two part clear non-ambering urethane elastomer, and it has a transmittance of at least 80% (for a 150 mils thick sheet) for wavelengths of 350 nm and greater (out to the end of the visible light spectrum at about 700 nm). The material has a refractive index of about 1.48. Without being limited to any particular theory, it is believed that the high transmission of this polyurethane material (in contrast to currently available polyurethane window materials) is the use of a polyurethane material that is substantially free of internal defects. Although current polyurethanes used for windows are generally free of additives, such materials can include internal defects, such as bubbles or voids, cracks, or microdomains (e.g., small areas of differing crystalline structure or orientation) that act to diffuse or scatter the light. By forming the polyurethane substantially free of internal defects, it is possible to achieve a high optical clarity. In some implementations, the transparent strip 118 is formed from a polyurethane material, for example, Calthane ND 3200. The material forming the transparent strip can have hardness on the Shore D scale of between about 50 and 80, such as 60. In some implementations, the material forming the transparent strip has a thickness of between about 50 mils and 55 mils.

Figure 12:
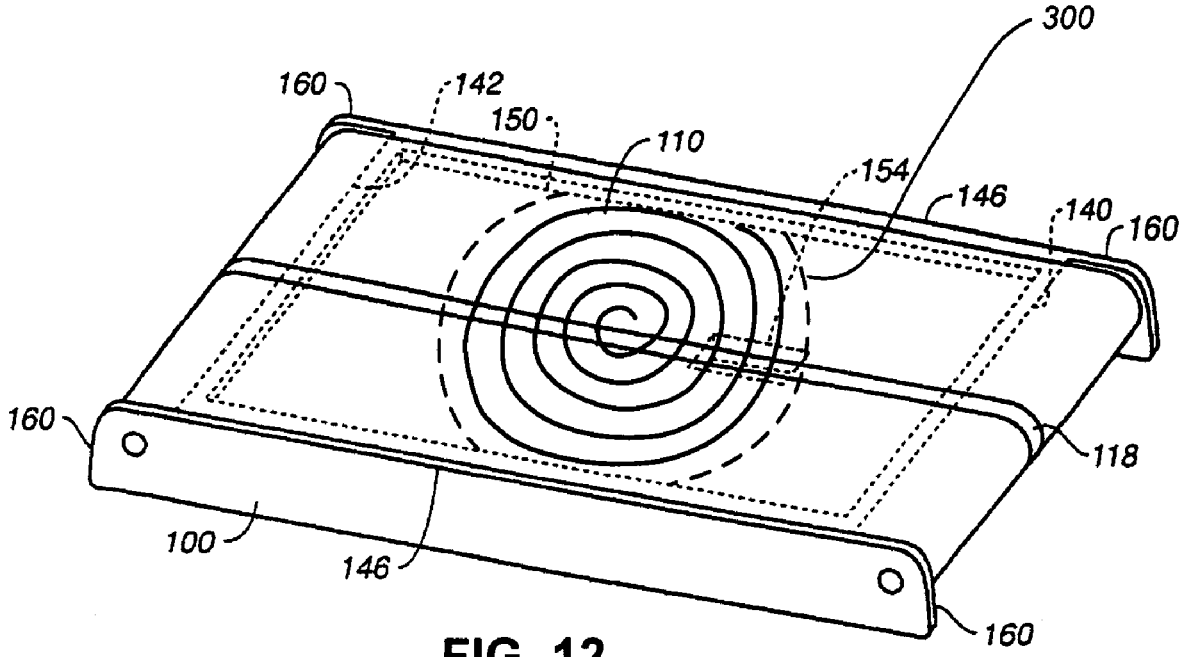
FIG. 12 shows a subpad with grooves on a rectangular platen.

Rectangular platen 100 includes a generally planar rectangular top surface 140 bounded by a feed edge 142, a take-up edge 144, and two parallel lateral edges 146. A groove 150 (shown in phantom in FIGS. 3A and 3C) is formed in top surface 140. The groove 150 may be a generally-rectangular pattern that extends along edges 142-146 of top surface 140. A passage 152 through platen 100 connects groove 150 to a vacuum source 200 (see FIG. 5). When passage 152 is evacuated, exposed portion 124 of polishing sheet 110 is vacuum-chucked to top surface 140 of platen 100. This vacuum-chucking helps ensure that lateral forces caused by friction between the substrate and the polishing sheet during polishing do not force the polishing sheet off the platen. As discussed, aperture 154 is formed in top surface 140 of rectangular platen 100. A compressible subpad 300 may be placed on the top surface of the platen 100 to cushion the impact of the substrate against the polishing sheet as shown in FIGS. 12 and 14. In addition, platen 100 may include an unillustrated shim plate. Shim plates of differing thickness may be attached to the platen to adjust the vertical position of the top surface of platen. The compressible subpad can be attached to the shim plate.

The subpad can be separate from the polishing sheet, that is, not integral with the polishing sheet or not adhered together. The subpad 300 can be formed from a single material or can be formed from multiple layers of materials. A pad formed of multiple layers of materials can be a stacked pad. In one embodiment, a stacked subpad has a layer of IC polishing material stacked on a layer of foam, such as a soft foam, for example, SUBA IV, available from Rohm and Haas of Newark, Del. The upper layer of the stacked pad can be between about 40 and 120 mils thick, such as between 60 and 100 mils, such as around 80 mils thick. The lower layer of the subpad can be between about 30 and 70 mils, such as between about 40 and 60 mils, such as around 50 mils thick.

Figure 13:
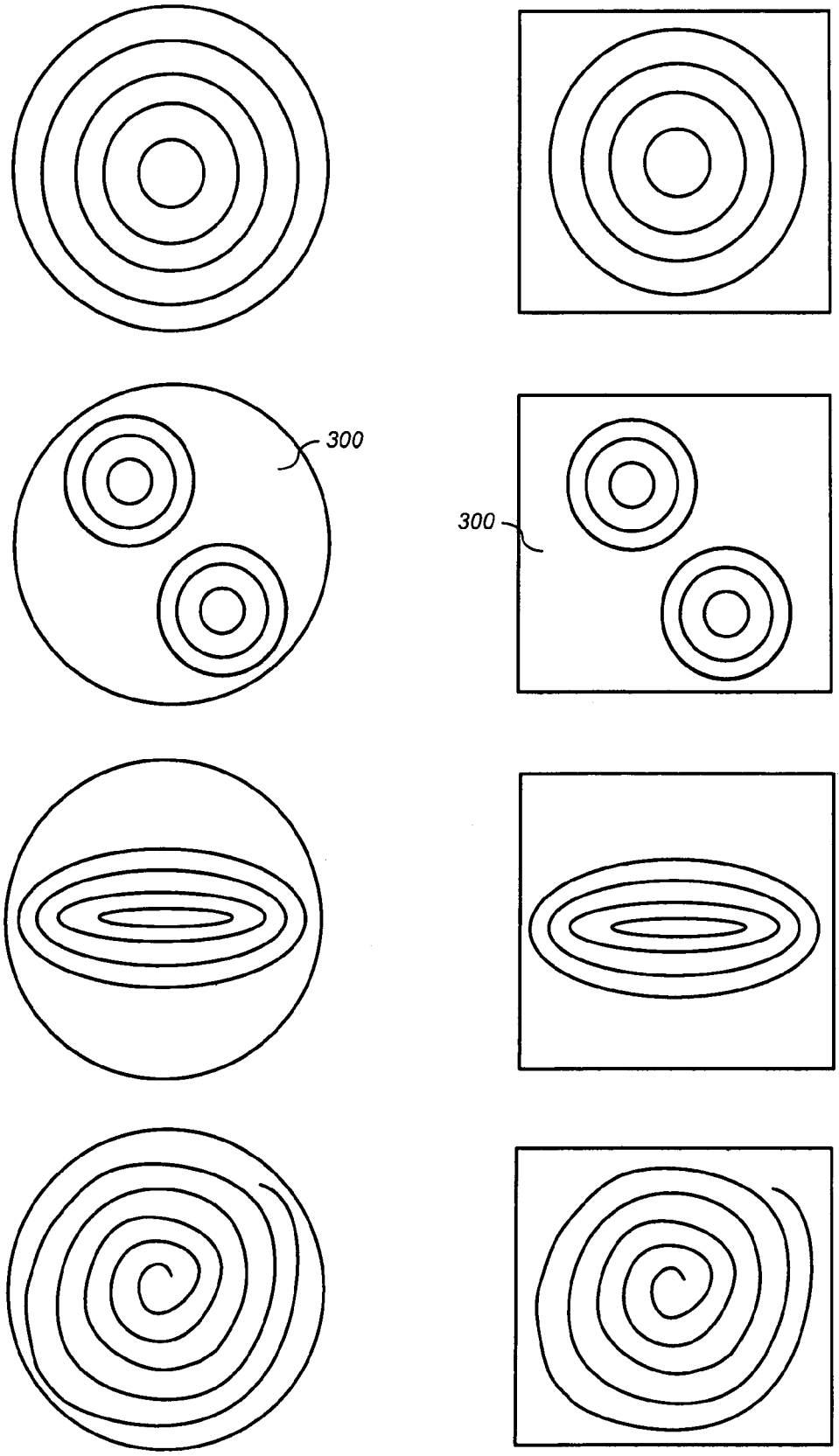
FIG. 13 shows variations of grooved subpads.
Figure 15:
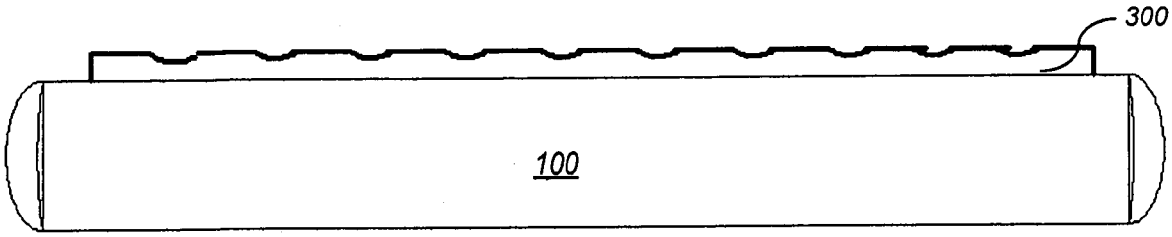
FIG. 15 shows a side view of a grooved subpad.
Figure 16:
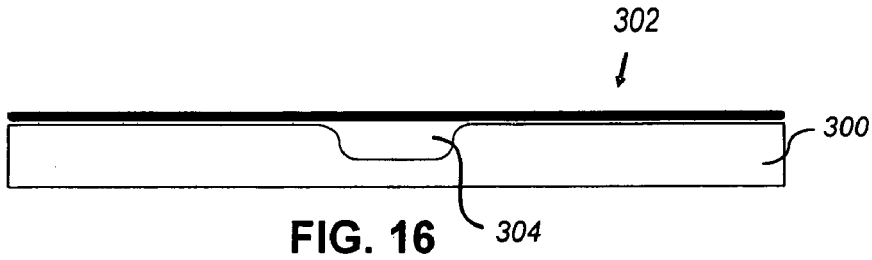
FIGS. 16-19 show a surface with a feature for dechuck.
Figure 17:
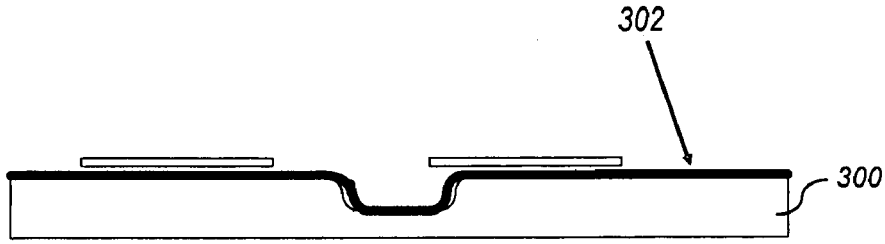

Referring to FIG. 15, the subpad 300 can have grooves that are the same or different from the grooves in the polishing layer. Referring to FIG. 13, the grooves can be circular, oval, off-center circular, or spiral. The grooves in the subpad 300 can be of sufficient depth and width such that when a vacuum is pulled on the subpad, grooves are introduced into the polishing sheet even if the overlying polishing sheet does not have grooves. The grooves can have a depth between about 30 and 50 mils, such as between about 35 and 40 mils. In some implementations, the grooves in the subpad can have a greater width, pitch, and/or depth than the grooves in the polishing surface. In some implementations, the groove pattern of the polishing surface is different than the groove pattern of a subpad. The subpad 300 can be circular, rectangular or any shape that is suitable for use with the platen 100.

Figure 20:
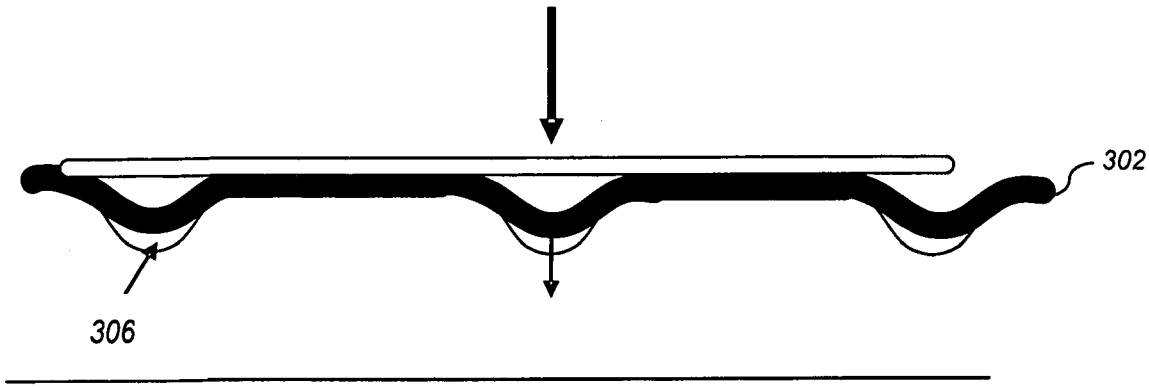
FIGS. 20-21 show a grooved subpad and a non-grooved polishing surface.
Figure 21:
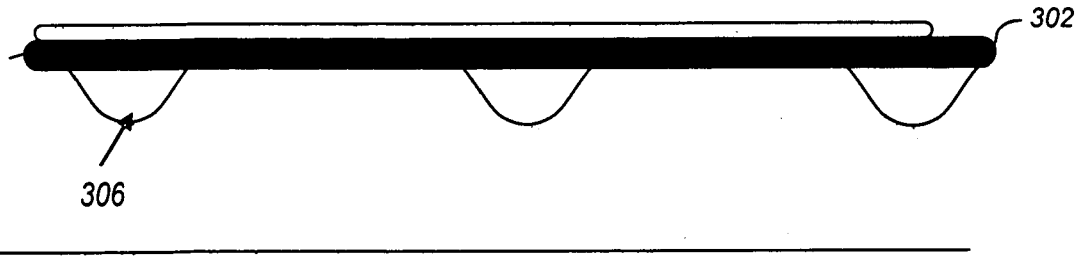

Referring to FIGS. 20-21, a pattern of grooves 306 is formed in one or more layers of the subpad material that support a polishing surface 302. The polishing surface 302 is pulled into the groove pattern by vacuum (as shown by the vertical arrows). The result is that a pattern of grooves is formed in the polishing surface 302. This groove pattern facilitates slurry distribution between the wafer and the polishing surface 302, and, consequently improves the process performance of the polisher. Thus, grooves are not required in the polishing surface. One advantage of forming grooves in the subpad 300 is that a web-style pad or linear sheet can exhibit or provide a circular or spiral groove pattern in the polishing surface and still be advanced in small increments without changing the location of the groove pattern.

The subpad has a surface that need not be a polishing layer. That is, the surface roughness or coefficient of friction of the subpad need not be sufficient for polishing a substrate surface. Additionally, the polishing pad or polishing sheet alone may not have much structural rigidity. The subpad can provide the structural rigidity.

The polishing performance of the polishing sheet or pad is influenced by the mechanical properties of the subpad. A stiff subpad and a softer subpad will provide different polishing results with the same polishing sheet or polishing pad. Because the subpad does not wear away as quickly as a polishing sheet or polishing pad, the subpad can have a longer useful life than the polishing layer. Thus, when the polishing sheet is advanced or changed, the same subpad can be continued to be used.

Figure 5:
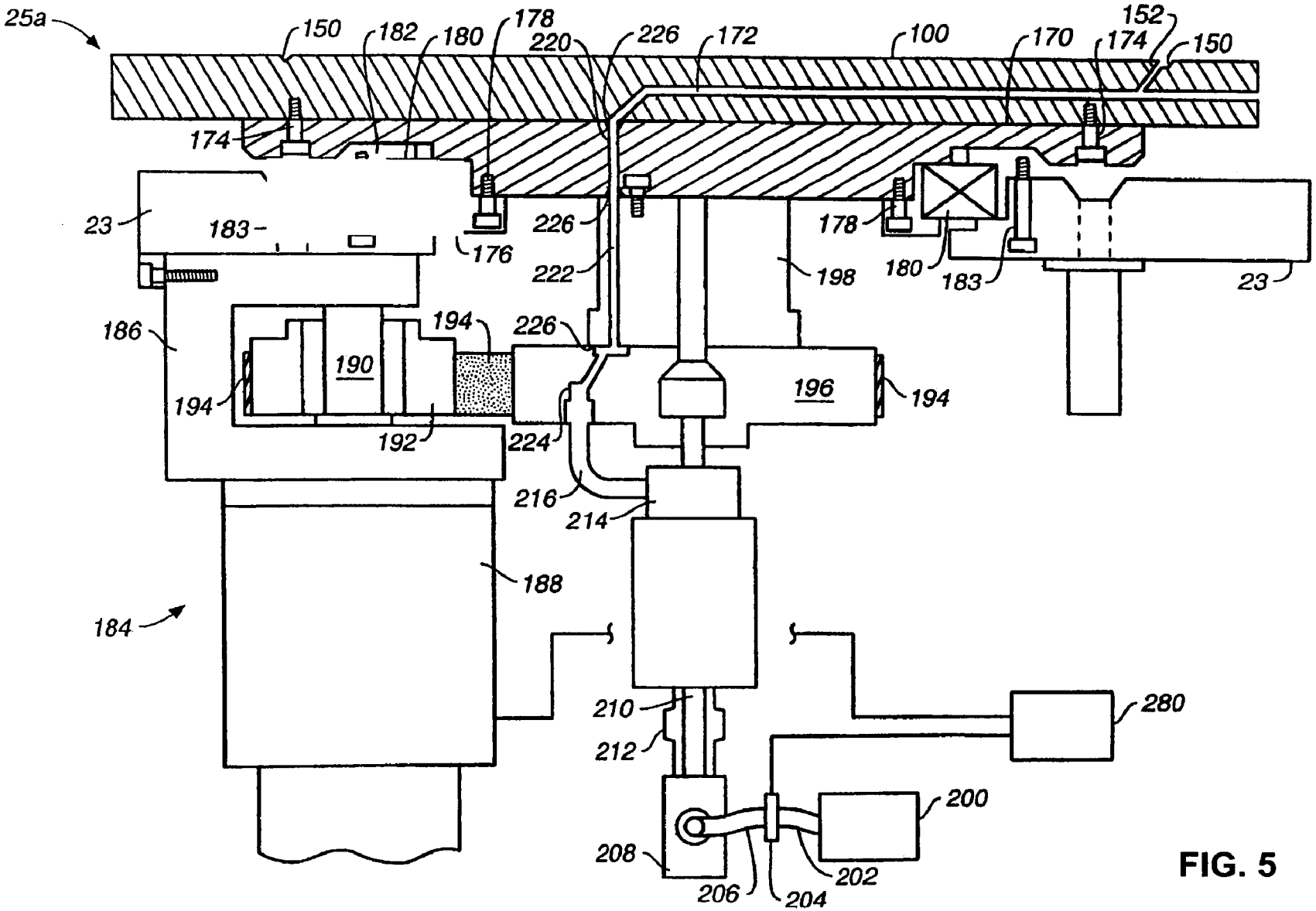
FIG. 5 is a schematic cross-sectional view of the polishing station of FIG. 3A.

As illustrated by FIG. 5, rectangular platen 100 is secured to a rotatable platen base 170. Rectangular platen 100 and platen base 170 may be joined by several peripheral screws 174 counter-sunk into the bottom of platen base 170. A first collar 176 is connected by screws 178 to the bottom of platen base 170 to capture the inner race of an annular bearing 180. A second collar 182, connected to table top 23 by a set of screws 183, captures the outer race of annular bearing 180. Annular bearing 180 supports rectangular platen 100 above table top 23 while permitting the platen to be rotated by the platen drive motor.

A platen motor assembly 184 is bolted to the bottom of table top 23 through a mounting bracket 186. Platen motor assembly 184 includes a motor 188 having an output drive shaft 190. Output shaft 190 is fitted to a solid motor sheath 192. A drive belt 194 winds around motor sheath 192 and a hub sheath 196. Hub sheath 196 is joined to platen base 170 by a platen hub 198. Thus, motor 188 may rotate rectangular platen 100. Platen hub 198 is sealed to lower platen base 170 and to hub sheath 196.

A pneumatic control line 172 extends through rectangular platen 100 to connect passage 152, and thus grooves 150, to a vacuum or pressure source. The pneumatic line 172 may be used both to vacuum-chuck the polishing sheet and to power or activate a polishing sheet advancement mechanism, which is further described in U.S. Pat. No. 6,135,859, filed Apr. 30, 1999, the entire disclosure of which is incorporated herein by reference.

The platen vacuum-chucking mechanism may be powered by a stationary pneumatic source 200 such as a pump or a source of pressurized gas. Pneumatic source 200 is connected by a fluid line 202 to a computer controlled valve 204. The computer controlled valve 204 is connected by a second fluid line 206 to a rotary coupling 208. The rotary coupling 208 connects the pneumatic source 200 to an axial passage 210 in a rotating shaft 212, and a coupling 214 connects axial passage 210 to a flexible pneumatic line 216.

Vacuum-chucking passage 152 can be connected to flexible pneumatic line 216 via pneumatic line 172 through rectangular platen 100, a passage 220 in platen base 170, a vertical passage 222 in platen hub 198, and a passageway 224 in hub sheath 196. O-rings 226 may be used to seal each passageway.

A general purpose programmable digital computer 280 is appropriately connected to valve 204, platen drive motor 188, carrier head rotation motor 76, and a carrier head radial drive motor (not shown). Computer 280 can open or close valve 204, rotate platen 100, rotate carrier head 80 and move carrier head along slot 72.

Figure 6:
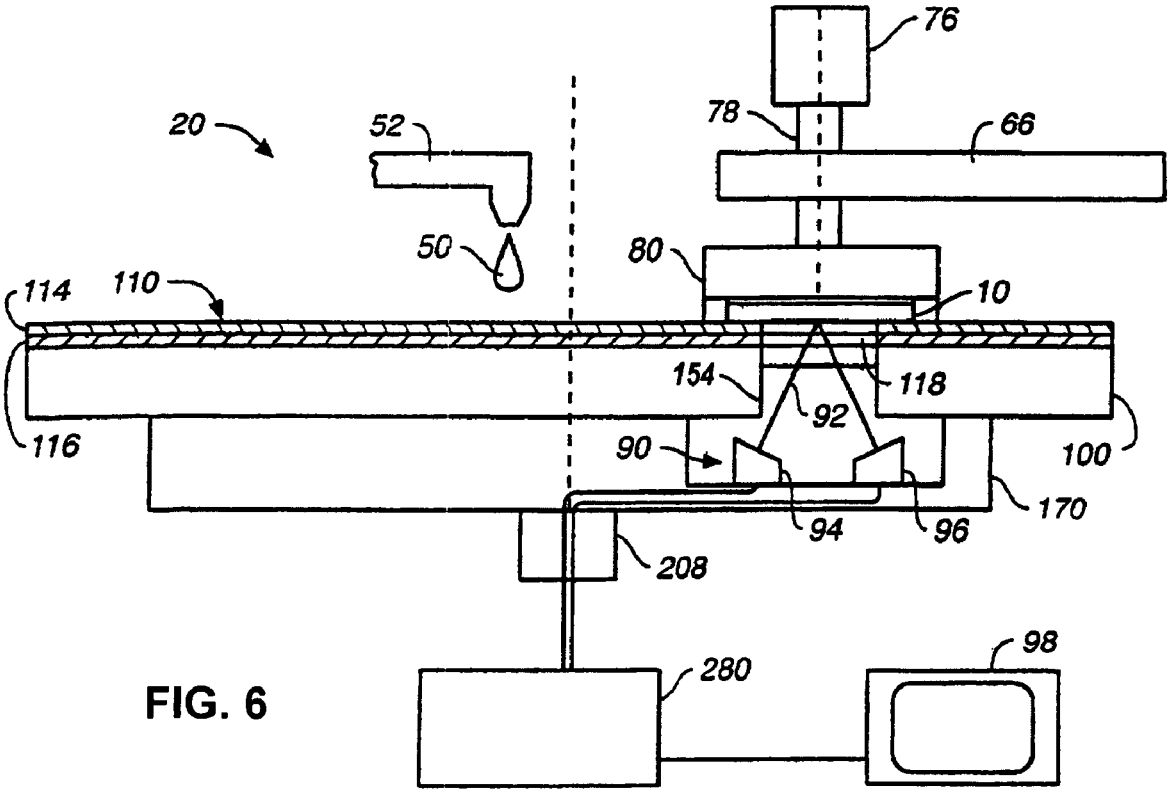
FIG. 6 is a schematic cross-sectional view of a polishing station having an optical endpoint detection system.

Referring to FIG. 6, in some embodiments an aperture or hole 154 is formed in platen 100 and is aligned with transparent strip 118 in polishing sheet 110. The aperture 154 and transparent strip 118 are positioned such that they have a view of substrate 10 during a portion of the platen's rotation, regardless of the translational position of the polishing head. An optical monitoring system 90 is located below and secured to platen 100, e.g., between rectangular platen 100 and platen base 170 so that it rotates with the platen. The optical monitoring system includes a light source 94 and a detector 96. The light source generates a light beam 92 which propagates through aperture 154 and transparent strip 118 to impinge upon the exposed surface of substrate 10.

Figure 9A:
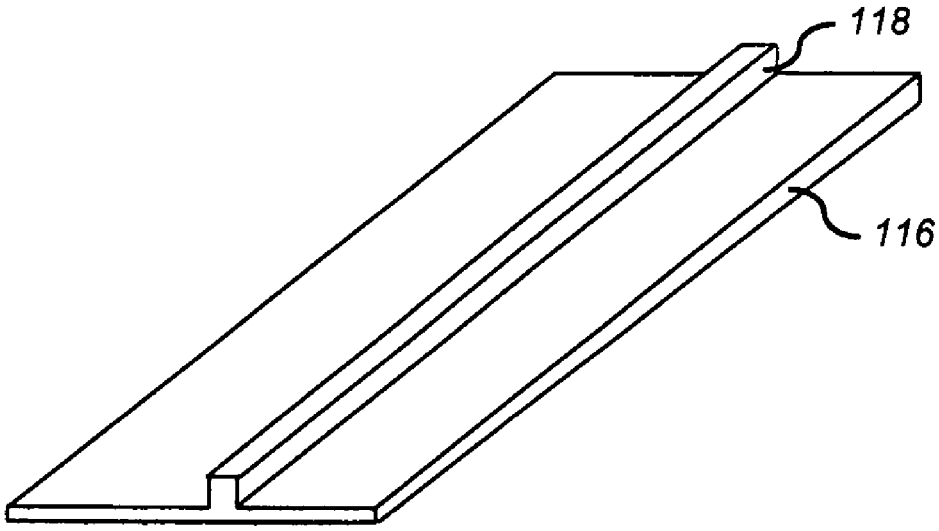
FIGS. 9A, 9B, 10A, 10B show a polishing sheet with an integrated window.
Figure 9B:
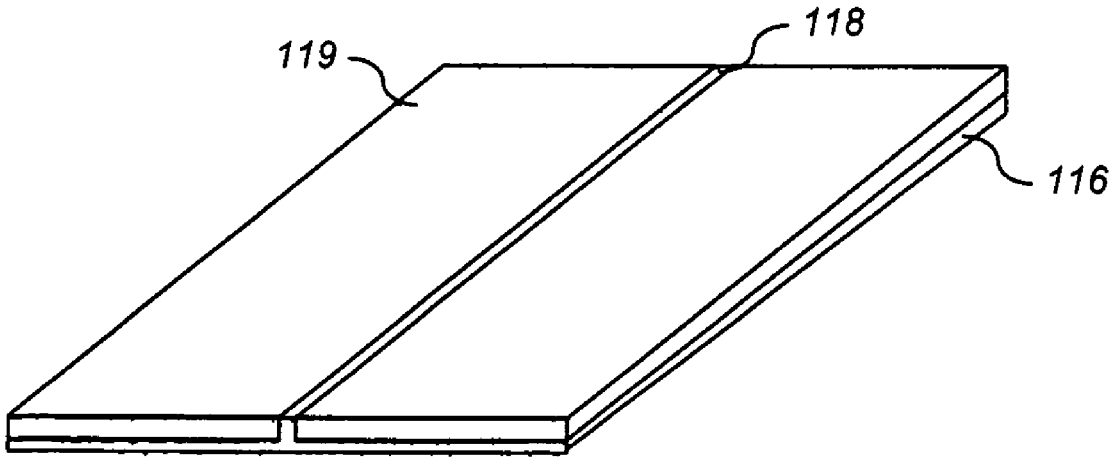
Figure 10A:
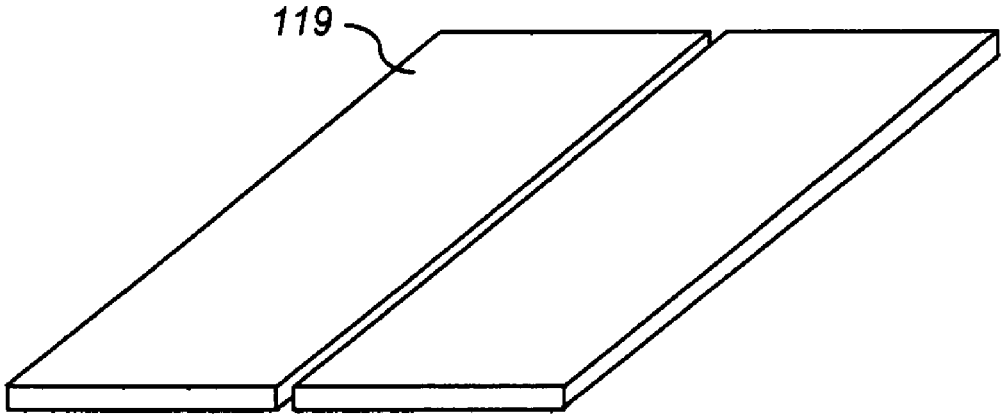
Figure 10B:
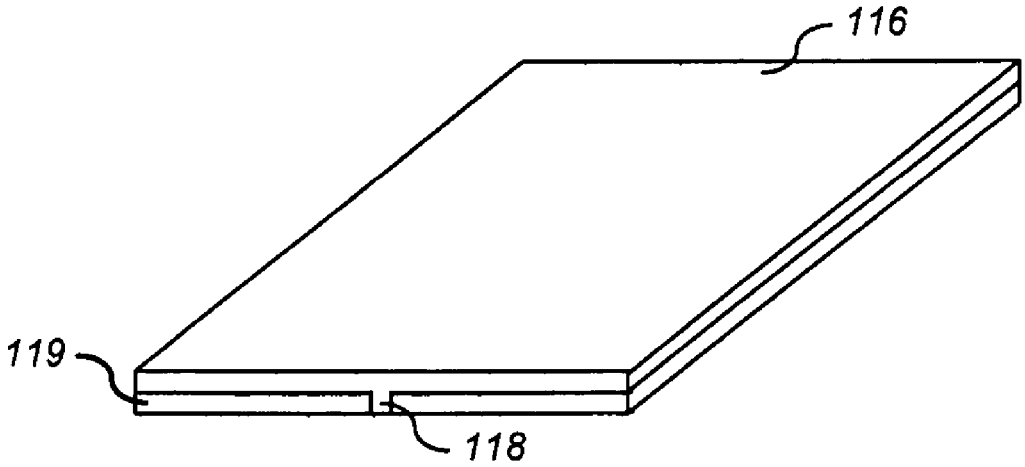

Referring to FIGS. 9B and 10B, in some implementations, the material that is used to form the transparent strip 118 in the polishing sheet 110 also forms the lower layer 116 of the polishing sheet 110. For example, the material can be a polymer material. Referring to FIG. 9A, in some implementations, the transparent strip 118 is formed with the lower layer 116. The material that forms polishing layer 119 can then be formed on the lower layer 116, such as by casting. If any of the polishing layer material covers the transparent strip 118, this material can be removed from over the transparent strip 118. The exposed surface of the transparent strip 118 can be substantially planar with the exposed surface of the polishing layer 119.

Referring to FIG. 10A, in some implementations, the polishing layer 119 is fabricated before the lower layer 116. A recess is formed in the polishing layer 119 or the polishing layer 119 is formed of two separate pieces. The lower layer 116 and transparent strip 118 are then fabricated on the polishing layer 119. The transparent strip 118 can therefore by formed simultaneously with the lower layer 116 and can be integral with the lower layer 116. There may not be a seam at the junction of the lower layer 116 and the transparent strip 118. Either of the polishing layer 119 or the lower layer 116 can be formed by molding, extruding, casting, shaping with pinch rollers, ablating or mechanical milling. In some instances, the layer that is formed first is allowed to dry or cure. The second layer is then fabricated on top of the first. In some implementations, the two layers are formed separately and adhered or welded together. In any of the implementations, the transparent strip 118 extends from the top surface of the polishing sheet to the bottom surface of the polishing sheet, yielding a window. The top surface of the polishing layer is substantially free of abrasives. Grooves can be formed in the polishing surface after or while the surface is being formed. The transparent strip 118 can be free of grooves. However, in some implementations, grooves are also formed in the transparent strip 118. In some implementations, the window extends the entire length of the polishing layer. In some implementations, the carrier layer extends across the width of the polishing layer.

Figure 22:
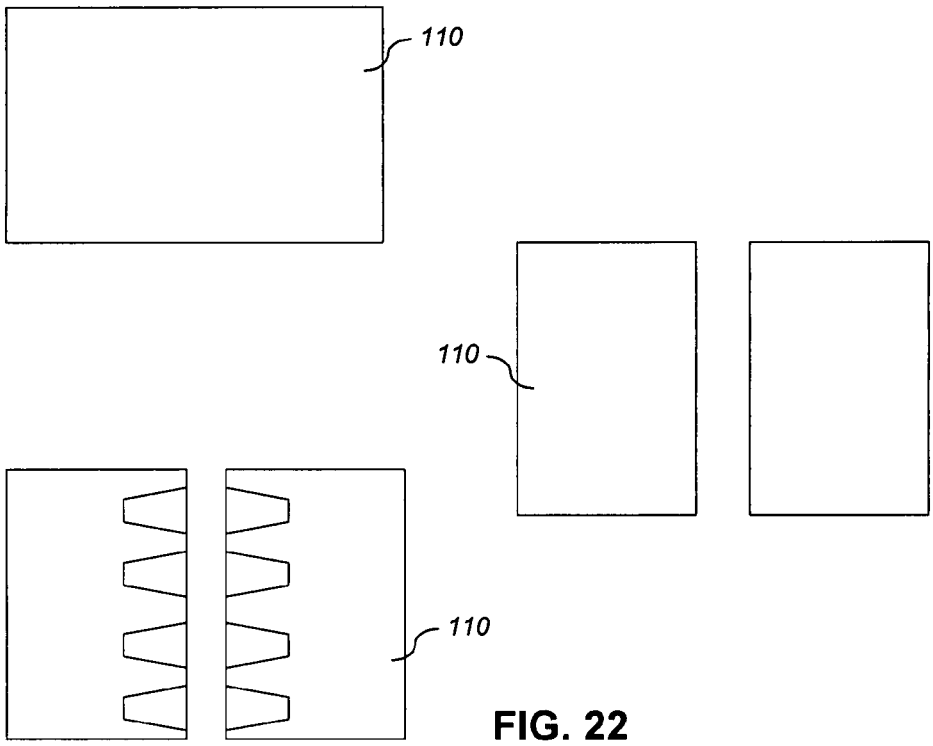
FIGS. 22-24 show a method of forming a polishing sheet with a window.
Figure 23:
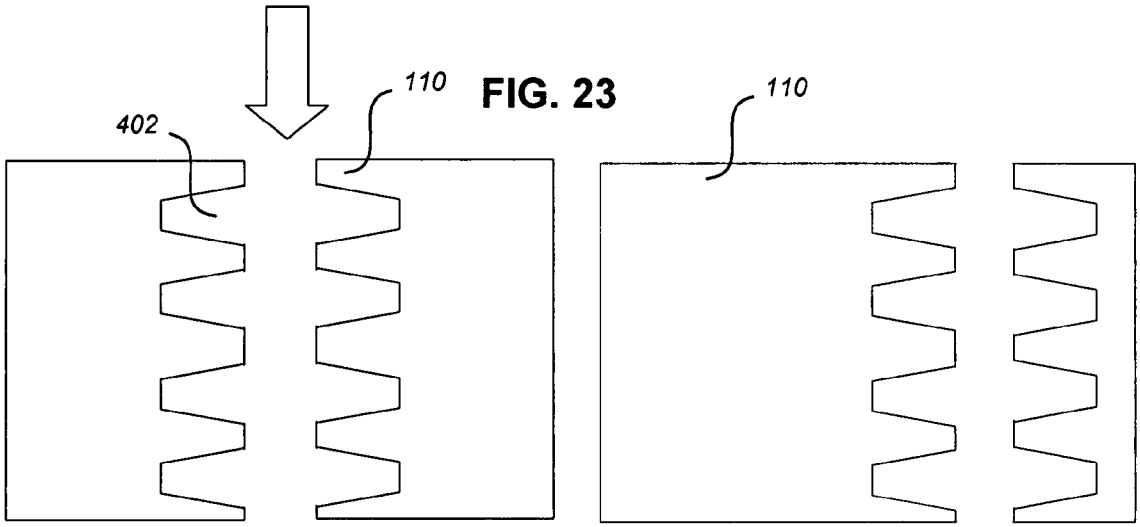
Figure 24:
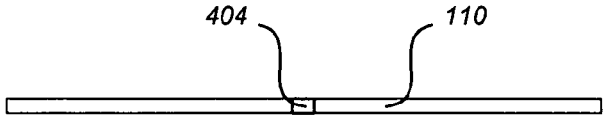

Referring to FIGS. 22-24, an alternative method is shown for forming the window 404 in the polishing sheet 110. Referring to FIG. 22, a polishing sheet is formed from a material suitable for polishing a substrate. The polishing sheet can be formed by molding, cutting or extruding. A plurality of dovetail-like openings 402, fissures or grooves are formed in the polishing sheet. The two halves are separated by the desired width of the window 404. Referring to FIG. 23, material that can be dried, cured or hardened is inserted into the groove (as indicated by the arrow). The material, such as a liquid precursor of the window material, is then dried, cured or hardened forming a composite polishing sheet. Referring to FIG. 24, the window material is intimately bonded to the polishing material, with projections of the window material interlocking with projections of the polishing material (not shown). The window material can be selected so that the window material and polishing material of the composite polishing sheet will wear evenly or uniformly and bend around the same radii without delaminating. Other process steps may also be required, such as cutting the sheet or skiving the sheet from a cast block of pad material. The window can be centered and generally equidistant from the edges of the sheet or be between the edge of the polishing sheet and the center, as shown in FIG. 23. The window can extend substantially the entire length of the polishing sheet. In some implementations, a surface of the window can be substantially planar with a surface of the polishing sheet.

In operation, CMP apparatus 20 uses optical monitoring system 90 to determine the thickness of a layer on the substrate, to determine the amount of material removed from the surface of the substrate, or to determine when the surface has become planarized. The computer 280 may be connected to light source 94 and detector 96. Electrical couplings between the computer and the optical monitoring system may be formed through rotary coupling 208. The computer may be programmed to activate the light source when the substrate overlies the window, to store measurements from the detector, to display the measurements on an output device 98, and to detect the polishing endpoint, as described in U.S. Pat. Nos. 6,159,073 and 6,280,289, filed Nov. 2, 1998, the entire disclosures of which are incorporated herein by reference.

In operation, exposed portion 124 of polishing sheet 110 or the subpad is vacuum-chucked to rectangular platen 100 by applying a vacuum to passage 152. A substrate is lowered into contact with polishing sheet 110 by carrier head 80, and both platen 100 and carrier head 80 rotate to polish the exposed surface of the substrate.

After polishing, the substrate is lifted off the polishing pad by the carrier head. The vacuum on passage 152 is removed. The polishing sheet is advanced, such as by applying a positive pressure to pneumatic line 172 to trigger the advancement mechanism. Alternatively, the positive pressure is used to blow the sheet off the platen and ease sheet advancement. This exposes a fresh segment of the polishing sheet. The polishing sheet is then vacuum-chucked to the rectangular platen, and a new substrate is lowered into contact with the polishing sheet. Thus, between each polishing operation, the polishing sheet may be advanced incrementally. If the polishing station includes a cleaning apparatus, the polishing sheet may be washed between each polishing operation.

The amount that the sheet may be advanced will depend on the desired polishing uniformity and the properties of the polishing sheet, but should be on the order of 0.05 to 1.0 inches, e.g., 0.4 inch, per polishing operation. Assuming that the exposed portion 124 of polishing sheet is 20 inches long and the polishing sheet advances 0.4 inches after each polishing operation, the entire exposed portion of the polishing sheet will be replaced after about fifty polishing operations.

When the substrate has been polished, the carrier head removes the substrate from the polishing layer, that is, the carrier head dechucks the substrate from the polishing surface. The substrate can be removed from the polishing surface by applying a suction to the back of the substrate and lifting. The slurry in combination with a flat wafer can make it difficult to remove the substrate from the polishing surface because of the strong surface tension.

In some implementations, the polishing sheet, polishing pad or subpad has a feature, such as a groove or an embossed feature, that can aid in wafer dechuck. During polishing, the substrate is in contact with a portion of the polishing surface that does not include or is not over the feature. After polishing, the edge of the substrate is moved over the feature, where the feature can serve as a dechuck enhancement feature.

Figure 18:
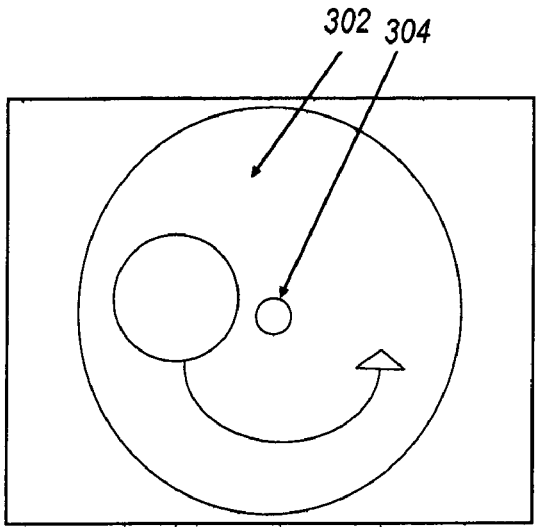
Figure 19:
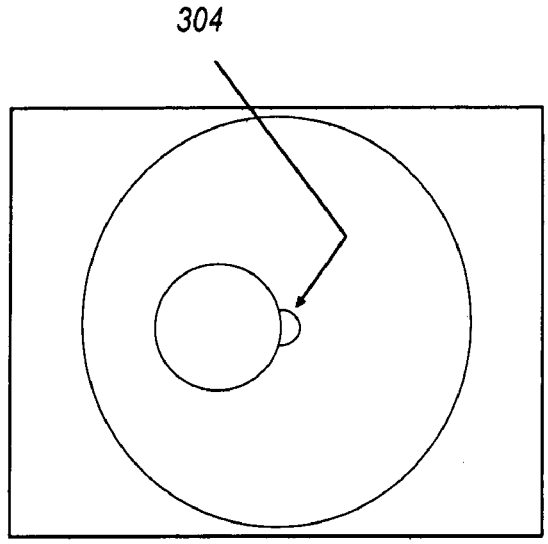

Referring to FIGS. 16-19, in some implementations, a subpad 300 has a feature 304 suitable to assist with substrate dechuck. When no platen vacuum is applied, the polishing surface 302 does not follow the contour of the feature 304 in the subpad (FIG. 19). When a vacuum is applied, the polishing surface 302 conforms to the feature 304. A substrate is not over the feature during polishing. During dechuck, a substrate is partially over the feature. FIGS. 18-19 show plan views of the substrate during polishing and during dechuck, respectively.

In the polishing sheet, the dechuck feature can be formed along the centerline of the sheet, along an edge or between the edge and the centerline of the polishing sheet.

Figure 7:
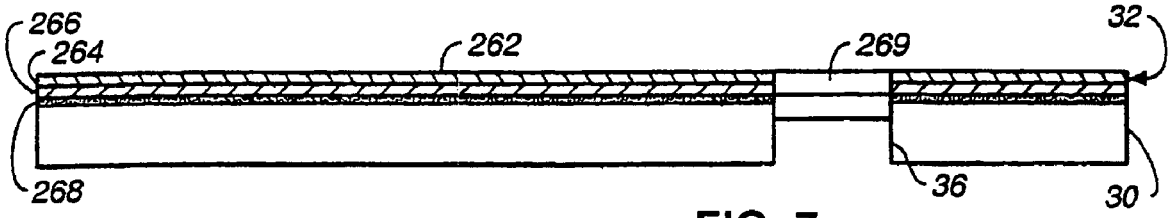
FIG. 7 is a schematic cross-sectional view of a platen and polishing pad of a second polishing station.

Referring to FIG. 7, at second polishing station 25*b*, the circular platen may support a circular polishing pad 32 having a roughened surface 262, an upper layer 264 and a lower layer 266. Lower layer 266 may be attached to platen 30 by a pressure-sensitive adhesive layer 268. Upper layer 264 may be harder than lower layer 266. For example, upper layer 264 may be composed of microporous polyurethane or polyurethane mixed with a filler, whereas lower layer 266 may be composed of compressed felt fibers leached with urethane. A two layer polishing pad, with the upper layer composed of IC 1000 or IC-1400 and the lower layer composed of SUBA IV, is available from Rohm and Haas of Newark, Del. (IC 1000, IC-1400 and SUBA IV are product names of Rohm and Haas). A transparent window 269 may be formed in polishing pad 32 over an aperture 36 in platen 30.

Figure 8:
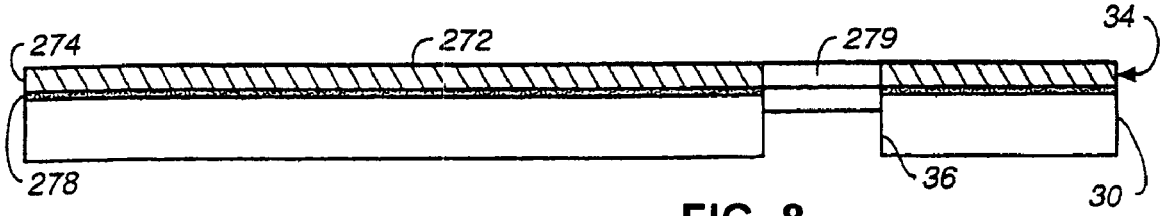
FIG. 8 is a schematic cross-sectional view of a platen and polishing pad of a final polishing station.

Referring to FIG. 8, at final polishing station 25*c*, the platen may support a polishing pad 34 having a generally smooth surface 272 and a single soft layer 274. Layer 274 may be attached to platen 30 by a pressure-sensitive adhesive layer 278. Layer 274 may be composed of a napped poromeric synthetic material. A suitable soft polishing pad is available from Rohm and Haas, under the trade name Politex™. Polishing pads 32 and 34 may be embossed or stamped with a pattern to improve distribution of slurry across the face of the substrate. Polishing station 25*c* may otherwise be identical to polishing station 25*b*. A transparent window 279 may be formed in polishing pad 34 over aperture 36.

In some implementations, the circular polishing pad 32, 34 can have a spiral groove or multiple spiral grooves, such as two spiral grooves starting 180 degrees apart, giving a groove-to-groove pitch in the radial direction, or three, four, or more spiral grooves.

Although the CMP apparatus is described as vacuum chucking the polishing sheet to the platen, other techniques could be used to secure the polishing sheet to the platen during polishing. For example, the edges of the polishing sheet could be clamped to the sides of the platen by a set of clamps.

Also, although the rollers are described as connected to the retainers by pins that are inserted through apertures, numerous other implantations are possible to rotatably connect the rollers to the platen. For example, a recess could be formed on the inner surface of the retainer to engage a pin that projects from the end face of the roller. The retainers 160 may be slightly bendable, and the rollers might be snap-fit into the retainers. Alternately, the recess in the inner surface of the retainer could form a labyrinth path that traps the rollers due to tension. Alternately, the retainer could be pivotally attached to the platen, and the roller could engage the retainer once the retainer is locked in position.

In addition, although the CMP apparatus is described as having one rectangular platen with a grooved surface and two circular platens with round polishing pads, other configurations are possible. For example, the apparatus can include one, two or three rectangular platens. The pad, sheet and subpad embodiments described herein can be used with continuous belts, non-rotating platen systems, and polishing systems with only one polishing station. In fact, one advantage of CMP apparatus 20 is that each platen base 170 is adaptable to receive either a rectangular platen or a circular platen. The polishing sheet on each rectangular platen may be a fixed abrasive or a non-fixed abrasive polishing material. The polishing sheet can include multiple layers which are bonded together. Similarly, each polishing pad on the circular platen can be a fixed-abrasive or a non-fixed abrasive polishing material. The standard polishing pads can have a single hard layer (e.g., IC-1000), a single soft layer (e.g., as in a Politex™ pad), or two stacked layers (e.g., as in a combined IC-1000/SUBA IV polishing pad). Different slurries and different polishing parameters, e.g., carrier head rotation rate, platen rotation rate, carrier head pressure, can be used at the different polishing stations.

One implementation of the CMP apparatus may include two rectangular platens with fixed-abrasive polishing sheets for primary polishing, and a circular platen with a soft polishing pad for buffing. The polishing parameters, pad composition and slurry composition can be selected so that the first polishing sheet has a faster polishing rate than the second polishing sheet.

When a subpad and the polishing sheet 110 are used together, the polishing sheet 110 slides across the subpad between or during polishes.

With some of the polishing sheets described herein, a number of wafers and each wafer will be polished by a portion of the polishing sheet that has not previously been used to polish another pad. Alternatively, the polishing sheet can be moved incrementally rather than a full length between each substrate polish. Pad wear will not be a factor in polishing subsequent wafers, because each wafer is exposed to substantially the same polishing pad conditions. A steady-state for the pad surface will result once the sheet has been incremented the distance equal to the diameter of the polishing area.

Grooves in the top surface of the polishing sheet that are perpendicular to the direction of travel of the polishing sheet can aid the polishing sheet in bending when the sheet is rolled or stretches across the small radius of the feed roller 130 before reaching the wafer. If a system has grooves in a subpad, the subpad can form temporary grooves in the polishing surface, aiding in slurry transport and flow across the surface of the pad. The temporary grooves can be more pronounced when a vacuum is applied to the subpad. Alternatively, or in addition, the polishing surface of a polishing pad can have grooves.

The grooves of a pad or a subpad can have a spiral shape. The spiral grooves can pump slurry toward the polishing surface. The spiral grooves originate from the center of the pad or subpad and move out towards the outer edge. As the platen rotates, the spirals converge toward or away from the center of the polishing area. The grooves perform a global action of either retaining slurry on the platen or moving exhausted slurry and/or polish waste products off the platen and away from the wafer. If the platen is rotated in the direction of increasing spiral groove radius so that the spiral appears to converge, that is move toward the center, slurry is transported toward the center. If the platen is rotated in the direction of decreasing spiral groove radius so that the spiral appears to expand, spent slurry and waste products are moved off of the platen more quickly than by centrifugal force alone. A pad or subpad with multiple spirals, e.g., two spirals, can move the slurry faster than a pad or subpad with a single groove.

In addition to any slurry transporting or pumping action, spiral grooves in the polishing layer or subpad can control polishing undulations or in homogeneities in removal of material from the wafer surface. In some implementations, the subpad can have a thickness of about 150 mils. In some implementations, the spiral grooves can have a depth of between about 40 mils and 60 mils, such as about 50 mils, and a width of between about 400 mils and 600 mils, such as 500 mils. The pitch of the grooves can be about 1 inch.

Alternative embodiments of the platen can have a central region of top surface free from grooves to prevent potential deflection of the polishing sheet into the grooves from interfering with the polishing uniformity.

A number of embodiments of the invention have been described. Nevertheless, it will be understood that various modifications may be made without departing from the spirit and scope of the invention. Accordingly, other embodiments are within the scope of the following claims.

What is claimed is:

1. A polishing apparatus, comprising:

a rotatable platen;

a polishing sheet having a polishing surface with a plurality of grooves in the polishing surface, the plurality of grooves forming a first groove pattern;

a drive mechanism to incrementally advance the polishing sheet in a linear direction across the platen;

a subpad on the platen to support the polishing sheet, the subpad having a groove formed therein, the groove of the subpad forming a second groove pattern, the second groove pattern different from the first groove pattern; and a vacuum source connected to the groove of the subpad and configured to apply a vacuum sufficient to pull portions of the polishing sheet into the groove of the subpad to induce another groove in the polishing surface.

2. The polishing apparatus of claim 1, wherein the subpad comprises a plurality of grooves.

3. The polishing apparatus of claim 2, wherein the plurality of grooves of the subpad form concentric circles, concentric ovals, parallel lines, or perpendicular lines.

4. The polishing apparatus of claim 1, wherein the subpad comprises a spiral groove.

5. The polishing apparatus of claim 1, wherein the polishing sheet has a width and a length, wherein the length is greater than the width, and the plurality of grooves formed in the polishing sheet include grooves extending substantially perpendicular to the length of the polishing sheet.

6. The polishing apparatus of claim 5, wherein the plurality of grooves formed in the polishing sheet include grooves extending substantially parallel to the length of the polishing sheet.

7. The polishing apparatus of claim 1, wherein the subpad is more compressible than the polishing sheet.

8. The polishing apparatus of claim 1, wherein the subpad is compressible.

9. A method of operating a polishing apparatus, comprising:

supporting a polishing sheet having a polishing surface on a subpad, the polishing sheet having a plurality of grooves in the polishing surface, the plurality of grooves forming a first groove pattern, the subpad having a groove formed therein, the groove of the subpad forming a second groove pattern, the second groove pattern different from the first groove pattern; and applying a vacuum to the groove of the subpad sufficient to pull portions of the polishing sheet into the groove of the subpad to induce another groove in the polishing surface.

10. The method of claim 9, further comprising rotating a platen supporting the polishing sheet to rotate the polishing sheet.

11. The method of claim 10, further comprising bringing a substrate into contact with the polishing sheet and polishing the substrate.

12. The method of claim 10, further comprising releasing the polishing sheet from the platen, and incrementally advancing the polishing sheet in a linear direction across the top surface of the platen.

13. The method of claim 9, wherein the subpad comprises a plurality of grooves, wherein the grooves of the subpad form concentric circles or concentric ovals.

14. The method of claim 9, wherein the subpad comprises a spiral groove.

* * * * *